US009283568B2

(12) United States Patent
Belotserkovskiy et al.

(10) Patent No.: US 9,283,568 B2
(45) Date of Patent: Mar. 15, 2016

(54) METHOD OF CONTROLLING AN INERTIA CONE CRUSHER

(71) Applicants: Konstantin Belotserkovskiy, Malmo (SE); Rickard Svensson, Svedala (SE)

(72) Inventors: Konstantin Belotserkovskiy, Malmo (SE); Rickard Svensson, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/360,858

(22) PCT Filed: Nov. 13, 2012

(86) PCT No.: PCT/EP2012/072508

§ 371 (c)(1),
(2) Date: May 27, 2014

(87) PCT Pub. No.: WO2013/079317

PCT Pub. Date: Jun. 6, 2013

(65) Prior Publication Data

US 2014/0306040 A1 Oct. 16, 2014

(30) Foreign Application Priority Data

Nov. 28, 2011 (EP) ..... 11190859

(51) Int. Cl.
*B02C 25/00* (2006.01)
*B02C 2/04* (2006.01)

(52) U.S. Cl.
CPC . *B02C 25/00* (2013.01); *B02C 2/04* (2013.01); *B02C 2/042* (2013.01)

(58) Field of Classification Search
CPC ..... B02C 25/00; B02C 2/00; B02C 2/04; B02C 2/042
USPC ..... 241/36, 207–216
See application file for complete search history.

(56) References Cited

U.S. PATENT DOCUMENTS

| | | | | |
|---|---|---|---|---|
| 8,172,167 | B2 * | 5/2012 | Hedin et al. | 241/37 |
| 8,960,577 | B2 * | 2/2015 | Tjell et al. | 241/30 |
| 2009/0294559 | A1 | 12/2009 | Eriksson et al. | |
| 2010/0181397 | A1 | 7/2010 | Wallin | |
| 2010/0327093 | A1 * | 12/2010 | Belotserkovsky | 241/30 |
| 2014/0166791 | A1 * | 6/2014 | Tjell et al. | 241/30 |

FOREIGN PATENT DOCUMENTS

| | | |
|---|---|---|
| EP | 0203026 A2 | 11/1986 |
| EP | 2116307 A1 | 11/2009 |

* cited by examiner

*Primary Examiner* — Faye Francis
(74) *Attorney, Agent, or Firm* — Corinne R. Gorski

(57) ABSTRACT

A method of controlling the crushing of material in an inertia cone crusher includes the step of charging material to be crushed from a feeding hopper to a crushing chamber formed between an inner crushing shell being supported on a crushing head, and an outer crushing shell of the inertia cone crusher. An unbalance bushing, which is provided with an unbalance weight and rotatably connected to the crushing head by a drive shaft, is rotated such that a central axis of the crushing head gyrates about a gyration axis. The number of revolutions of the unbalance bushing is sensed using an rpm sensor. The number of revolutions of the unbalance bushing is controlled by a control system and the material is crushed in the crushing chamber.

13 Claims, 3 Drawing Sheets

METHOD OF CONTROLLING AN INERTIA CONE CRUSHER

RELATED APPLICATION DATA

This application is a §371 National Stage Application of PCT International Application No. PCT/EP2012/072508 filed Nov. 13, 2012 claiming priority of EP Application No. 11190859.6, filed Nov. 28, 2011.

TECHNICAL FIELD OF THE INVENTION

The present invention relates to a method of controlling an inertia cone crusher. The present invention further relates to an inertia cone crusher performing the method.

BACKGROUND OF THE INVENTION

An inertia cone crusher may be utilized for efficient crushing of material, such as stone, ore etc. An example of an inertia cone crusher can be found in EP 2 116 307. Material to be crushed is fed from a feeding hopper into a crushing chamber formed between an outer crushing shell, which is mounted in a frame, and an inner crushing shell, which is mounted on a crushing head. The crushing head is mounted on a crushing head shaft. In an inertia cone crusher an unbalance weight is arranged on a cylindrical sleeve-shaped unbalance bushing encircling the crushing head shaft. The cylindrical sleeve is, via a drive shaft, connected to a pulley. A motor is operative for rotating the pulley and, hence, the cylindrical sleeve. Such rotation causes the unbalance weight to rotate and to swing to the side, causing the crushing shaft, the crushing head, and the inner crushing shell to gyrate and to crush material in the crushing chamber.

There is a need for efficient control methods for inertia cone crushers.

SUMMARY OF THE INVENTION

An object of the present invention is therefore to facilitate controlling of an inertia cone crusher and to optimize the energy and time consumption of an inertia cone crusher during, for instance, time-limited interruptions in the operation of an inertia cone crusher.

This object is achieved by means of a method of controlling the crushing of material in an inertia cone crusher, comprising charging material to be crushed from a feeding hopper to a crushing chamber formed between an inner crushing shell, being supported on a crushing head, and an outer crushing shell of the inertia cone crusher; rotating an unbalance bushing, which is provided with an unbalance weight and rotatably connected to the crushing head, by a drive shaft, such that a central axis of the crushing head gyrates about a gyration axis with a number of revolutions; sensing the number of revolutions of the unbalance bushing using an rpm sensor; controlling the number of revolutions of the unbalance bushing using a control system; and crushing material in the crushing chamber.

Optionally, the method comprising receiving a stand-by signal; and decreasing the number of revolutions of the unbalance bushing to a stand-by rpm, wherein the stand-by rpm is above 0 and below 30 rpm, or preferably above 0 and below 15 rpm, or most preferably above 0 and below 10 rpm. The stand-by rpm is a non-crushing rpm where substantially no crushing occurs in the crushing chamber of the inertia cone crusher. Substantially no crushing may occur at a number of revolutions below 30 rpm, or preferably below 15 rpm, or most preferably below 10 rpm. The stand-by rpm is higher than 0, i.e. the crusher is running, however the number of revolutions is kept below a number of revolutions where crushing occurs in the crushing chamber. It may be useful to decrease the number of revolutions to the stand-by rpm when a crushing stop is necessary, however, it may not be necessary to turn the crusher off. When the crusher is operating at a stand-by rpm the unbalance bushing may be rotated but at a number of revolutions which is low enough to avoid crushing action in the crushing chamber. Thus, at a stand-by rpm the crusher is stand-by for a quick start of the crusher and it is possible to move between normal crushing operation and stand-by rpm quickly and safely. It may, for example, be useful to run the crusher at stand-by rpm while solving a problem with the feeding of material into the feeding hopper of the crusher.

Optionally, the method comprises receiving a crushing signal; and increasing the number of revolutions of the unbalance bushing to a crushing rpm, wherein the crushing rpm is above 400 rpm. By crushing rpm is meant a number of revolutions at which material is crushed the crushing chamber. By increasing the number of revolutions from a stand-by rpm to a crushing rpm the crusher may be taken in operation quickly after a crushing pause at the stand-by rpm. For instance, since the crusher has not been shut off there is no need to run time-consuming start up programs.

Optionally, the inertia cone crusher is run at the stand-by rpm for a period which is less than 1 hour, preferably less than 30 minutes, and most preferably less than 15 minutes. Running the crusher at the stand-by rpm for a long time period, such as several hours, may give rise to lubrication difficulties. Therefore the stand-by rpm may be intended for use at time periods below 1 hour.

Optionally, the decreasing of the number of revolutions of the unbalance bushing to a stand-by rpm is performed while material to be crushed is present in the feeding hopper. During normal crushing operation material to be crushed is continuously fed from the feeding hopper to the crushing chamber and, thus, material is continuously fed to the feeding hopper from, for instance, a conveyor belt. However when the number of revolutions of the crusher is decreased to a stand-by rpm, crushing is stopped and therefore feeding of material from the feeding hopper may be stopped or limited. However, as soon as the number of revolutions is increased to a crushing rpm normal crushing may be resumed and the feeding hopper should again feed material to the crushing chamber. If the feeding hopper is empty, or if the level of material in the feeding hopper is low, there is a risk that the feeding hopper run out of material when crushing is resumed, which may cause damage on the crushing shells. Thus, by "having material to be crushed present in the feeding hopper" is meant that material to be crushed may be fed to the crushing chamber when there is available space for more material in the crushing chamber. Therefore, decreasing the number of revolutions to a stand-by rpm while material to be crushed is present in the feeding hopper secures that normal crushing operation may begin after a crushing pause at the stand-by rpm.

Optionally, the decreasing of the number of revolutions of the unbalance bushing to a stand-by rpm is performed during an emptying process of the inertia cone crusher. Running the crusher at a stand-by rpm for a period may be useful during emptying of the crusher. For instance if the number of revolutions is, by turns, increased and decreased above and below the limit where crushing occurs, respectively, a safe emptying process of the crusher may be achieved.

Optionally, the decreasing of the number of revolutions of the unbalance bushing to a stand-by rpm is performed when the inertia cone crusher is empty or nearly empty. If the inertia cone crusher is run without material the crushing shells may be damaged. However, if an empty or nearly empty crusher is run at a stand-by rpm, which in this context may be referred to as an idle rpm, the risk of damaging the crushing shells is lowered. If an empty or nearly empty crusher is not turned off but run at a stand-by rpm it may be fast, easy and safe to switch from stand-by rpm to normal crushing operation as soon as the crushing chamber holds a proper amount of material to be crushed.

Optionally, the method comprises sensing a power value of the inertia cone crusher; and applying a constant power input to the inertia cone crusher by correspondingly adjusting the number of revolutions of the unbalance bushing. A constant power input may give favourable grain properties.

A further object of the present invention is to provide an inertia cone crusher with efficient control systems. This object is achieved by means of an inertia cone crusher comprising an outer crushing shell and an inner crushing shell, the inner and outer crushing shells forming between them a crushing chamber, the inner crushing shell being supported on a crushing head, the crushing head being rotatably connected to an unbalance bushing, which is arranged to be rotated by a drive shaft, the unbalance bushing being provided with an unbalance weight for tilting the unbalance bushing when it is rotated, such that the central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber, wherein the inertia cone crusher comprises a controller configured to perform the method according to the method described hereinabove. Optionally, the inertia cone crusher comprises a sensor for sensing at least one of a position and a motion of the crushing head.

BRIEF DESCRIPTION OF THE DRAWINGS

The invention is described in more detail below with reference to the appended drawings in which.

DESCRIPTION OF PREFERRED EMBODIMENTS

Figure 1:
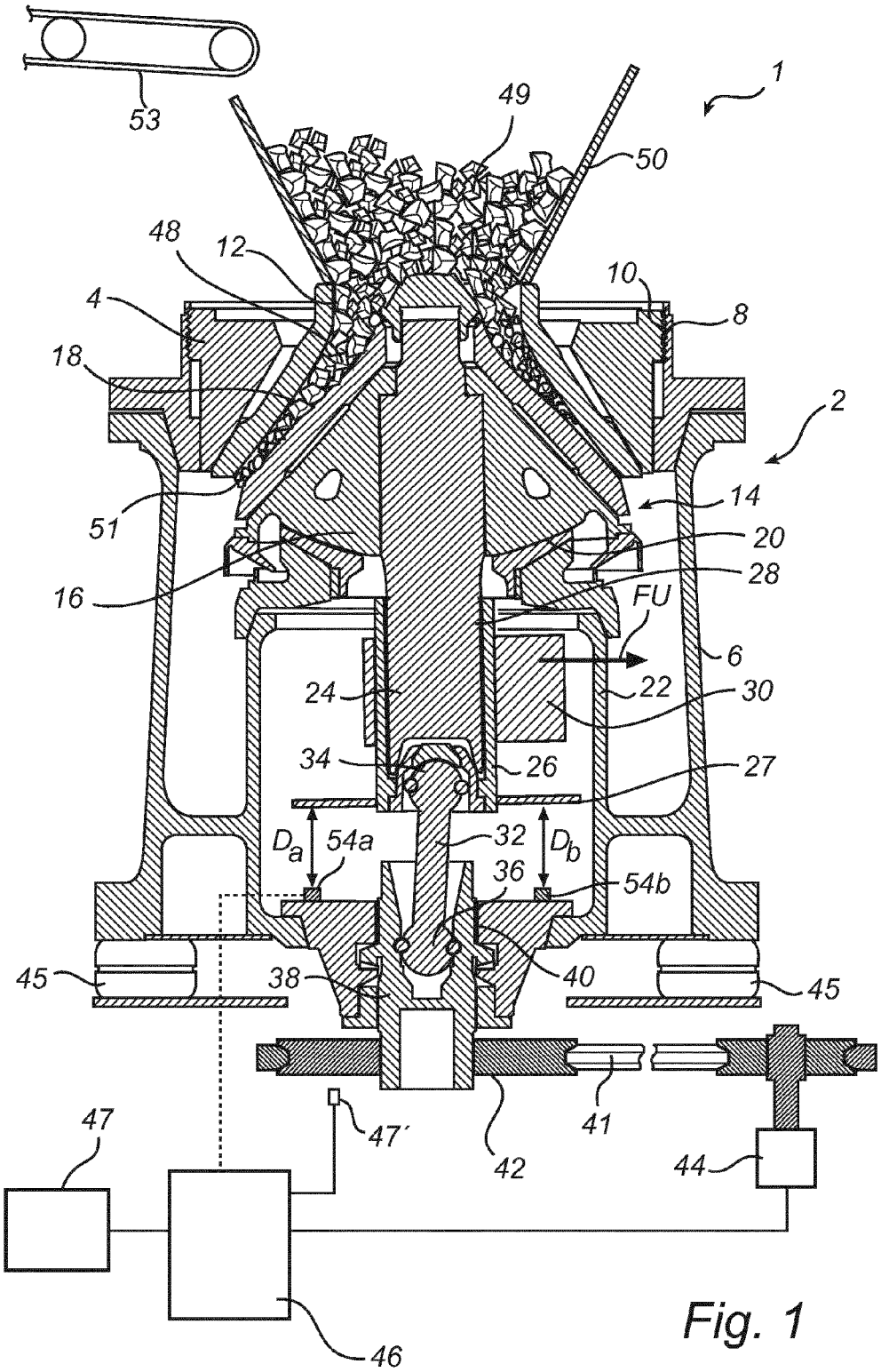
FIG. 1 is a schematic side view, in cross-section, of an inertia cone crusher.

FIG. 1 illustrates an inertia cone crusher 1 in accordance with one embodiment of the present invention. The inertia cone crusher 1 comprises a crusher frame 2 in which the various parts of the crusher 1 are mounted. The crusher frame 2 comprises an upper frame portion 4, and a lower frame portion 6. The upper frame portion 4 has the shape of a bowl and is provided with an outer thread 8, which co-operates with an inner thread 10 of the lower frame portion 6. The upper frame portion 4 supports, on the inside thereof, an outer crushing shell 12. The outer crushing shell 12 is a wear part which may be made from, for example, manganese steel.

The lower frame portion 6 supports an inner crushing shell arrangement 14. The inner crushing shell arrangement 14 comprises a crushing head 16, which has the shape of a cone and which supports an inner crushing shell 18, which is a wear part that can be made from, for example, a manganese steel. The crushing head 16 rests on a spherical bearing 20, which is supported on an inner cylindrical portion 22 of the lower frame portion 6.

The crushing head 16 is mounted on a crushing head shaft 24. At a lower end thereof, the crushing head shaft 24 is encircled by an unbalance bushing 26, which has the shape of a cylindrical sleeve. The unbalance bushing 26 is provided with an inner cylindrical bearing 28 making it possible for the unbalance bushing 26 to rotate relative to the crushing head shaft 24 about a central axis of the crushing head 16 and the crushing head shaft 24. As will be described in more detail in connection to FIG. 2, the crushing head 16 illustrated in FIG. 1 gyrates about a vertical axis. Thus, the central axis of the crushing head 16 is displaced from the vertical axis.

A gyration sensor reflection disc 27 stretches radially out from, and encircles, the unbalance bushing 26. The gyration sensor reflection disc 27 may be used for determining the rpm (revolutions per minute) of the crushing head 16.

An unbalance weight 30 is mounted on one side of the unbalance bushing 26. At its lower end the unbalance bushing 26 is connected to the upper end of a vertical transmission shaft 32 via a Rzeppa joint 34. Another Rzeppa joint 36 connects the lower end of the vertical transmission shaft 32 to a drive shaft 38, which is journalled in a drive shaft bearing 40. Rotational movement of the drive shaft 38 can thus be transferred from the drive shaft 38 to the unbalance bushing 26 via the vertical transmission shaft 32, while allowing the unbalance bushing 26 and the vertical transmission shaft 32 to be displaced from a vertical axis during operation of the crusher 1.

A pulley 42 is mounted on the drive shaft 38, below the drive shaft bearing 40. An electric motor 44 is connected via a belt 41 to the pulley 42. According to one alternative embodiment the motor may be connected directly to the drive shaft 38.

The crusher 1 is suspended on cushions 45 to dampen vibrations occurring during the crushing action.

The outer and inner crushing shells 12, 18 form between them a crushing chamber 48, to which material 49 that is to be crushed is supplied from a feeding hopper 50 located above the crushing chamber 48. The discharge opening 51 of the crushing chamber 48, and thereby the crushing capacity, can be adjusted by means of turning the upper frame portion 4, using the threads 8, 10, such that the distance between the shells 12, 18 is adjusted. Material 49 to be crushed may be transported to the feeding hopper 50 by a belt conveyor 53.

Figure 2:
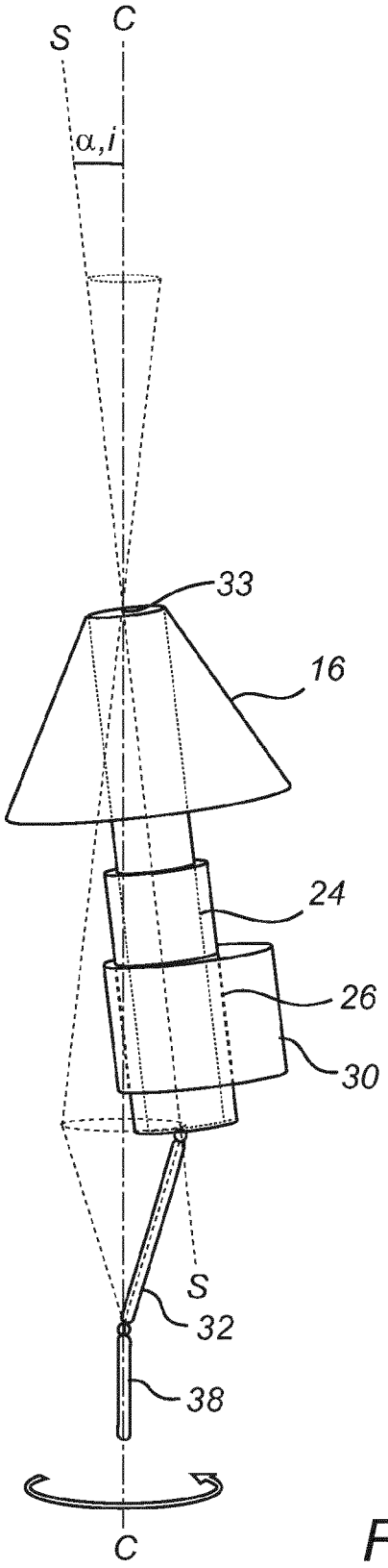
FIG. 2 is a schematic side view of the crushing head and the crushing head transmission parts of the inertia cone crusher of FIG. 1.

The crusher 1 is driven by the drive shaft 38, which is rotated by means of the motor 44. The rotation of the drive shaft 38 causes the unbalance bushing 26 to rotate and as an effect of that rotation, the unbalance bushing 26 swings outwards, in the direction FU of the unbalance weight 30, displacing the unbalance weight 30 further away from the vertical axis, in response to the centrifugal force to which the unbalance weight 30 is exposed. Such displacement of the unbalance weight 30, and of the unbalance bushing 26 to which the unbalance weight 30 is attached, is allowed thanks to the flexibility of the Rzeppa joints 34, 36 of the vertical transmission shaft 32, and thanks to the fact that the crushing head shaft 24 may slide somewhat in the axial direction in the cylindrical bearing 28 of the sleeve shaped unbalance bushing 26. The combined rotation and swinging of the unbalance bushing 26 causes an inclination of the crushing head shaft 24, and allows the central axis of the crushing head 16 and the crushing head shaft 24 to gyrate about a gyration axis, which, during normal operation for crushing material in the crusher 1, coincides with a vertical axis, such that material 49 is crushed in the crushing chamber 48 between the outer and inner crushing shells 12, 18. FIG. 2 illustrates the rotational movement principle of the crushing head 16 and its related parts. The central axis is denoted S in FIG. 2 and the vertical axis is denoted C in FIG. 2.

A control system 46 is configured to control the operation of the crusher 1. The control system 46 is connected to the motor 44, for controlling the power and/or the revolutions per minute (rpm) of the motor 44, and, hence, for controlling the rpm of the unbalance bushing 26. The control system 46 may, for example, control a frequency converter that supplies electric power to the motor 44. An indirect rpm sensor 47 is arranged for extracting rpm data from the control system 46. The indirect rpm sensor 47 provides readings of the present number of revolutions of the unbalance bushing 26. As an alternative a direct rpm sensor 47' may be installed for direct measurement of the rpm of, for example, the drive shaft 38 or the pulley 42.

In addition, the control system 46 may control the rpm of the unbalance bushing 26 by receiving readings from a gyration sensor 54, which senses the location and/or motion of the gyration sensor reflection disc 27. By way of example, the gyration sensor 54 may comprise three separate sensing elements, which are distributedly mounted in a horizontal plane beneath the gyration sensor reflection disc 27, for sensing three vertical distances to the gyration sensor reflection disc 27 in the manner described in detail in EP 2 116 307. Thereby, a complete determination of the tilt of the gyration sensor reflection disc 27, and hence also of the direction of the crushing head central axis S (FIG. 2) with respect to the vertical axis C (FIG. 2), may be obtained. In the section of FIG. 1, two sensing elements 54*a*, 54*b* of the sensor 54, for measuring two respective distances $D_a$, $D_b$, are illustrated; the third sensor is not visible in the section. In fact, the two distances $D_a$, $D_b$, obtained by the two sensors 54*a*, 54*b*, may, if the location of a third element, a fixed point, of the crushing head 16 or the crushing head shaft 24 is known, suffice for obtaining the direction or angle of the crushing head central axis S. A point which is referred to as apex 33 in FIG. 2, and which is described with reference to FIG. 2 below, may be used as such a fixed point.

According to the above, the sensor 54 is configured to obtain the angle of the central axis S (FIG. 2). Alternatively, the sensor 54 may comprise only one single sensing element 54*a* for sensing the distance $D_a$ to one single point on the gyration sensor reflection disc 27. Thereby, an amplitude of the vertical movement of that particular portion on the gyration sensor reflection disc 27 may be obtained. Since the gyration sensor reflection disc 27 is arranged on the unbalance bushing 26 it will gyrate along with the crushing head 16 and the gyrating amplitude of the gyration sensor reflection disc 27 may be used as the amplitude signal for the gyrating movement of the crushing head 16. The amplitude may alternatively be calculated as the time average, over an entire revolution of the crushing head 16 of the tilt angle $\alpha$ of the crushing head central axis S relative to the gyration axis C (FIG. 2), or, as will be described in connection to FIG. 2 below, the tilt angle $\alpha$ may be used directly as the amplitude.

For non-contact sensing of the distances $D_a$, $D_b$ to the gyration sensor reflection disc 27, the gyration sensor 54 may, for example, comprise a radar, an ultrasonic transceiver, and/or an optical transceiver. The gyration sensor 54 may also operate by mechanical contact with the gyration sensor reflection disc 27.

In alternative embodiments, the gyration sensor 54 may be configured to sense the absolute or relative location of other parts of the unbalance bushing 26, the crushing head 16, or any components attached thereto.

The crusher 1 shown in FIG. 1 is operating at a stand-by rpm, which means that the crusher 1 has been temporarily slowed down to a number of revolutions where no significant crushing occurs in the crushing chamber 48. Therefore no material to be crushed is fed into the crushing chamber 48 from the convenor belt 53, and no material is leaving the crushing chamber 48 in FIG. 1. However, the crushing chamber 48 may be full of material 49 and the feeding hopper 50 may hold material to be fed into the crushing chamber 48 as soon as the number of revolutions of the crusher 1 is increased to a crushing rpm. In other words, at the stand-by rpm the crusher 1 is run at an rpm high enough for keeping the crusher 1 running but low enough to avoid crushing to occur in the crushing chamber 48. The stand-by rpm may be used is situations when the crushing operation of the crusher 1 must be stopped but it might not be necessary to turn the crusher off.

FIG. 2 illustrates, schematically, the gyrating motion of the central axis S of the crushing head shaft 24 and the crushing head 16 about the vertical axis C during operation of the crusher 1. For reasons of clarity, only the rotating parts are schematically illustrated. In the same manner as described in connection to FIG. 1 the crushing head 16 illustrated in FIG. 2 gyrates about the vertical axis C. As the drive shaft 38 rotates the vertical transmission shaft 32 and the unbalance bushing 26, the unbalance weight 30 makes the unbalance bushing 26 swing out radially, thereby tilting the central axis S of the crushing head 16 and the crushing head shaft 24 relative to the vertical axis C. Thus, the central axis S of the crushing head 16 and the crushing head shaft 24 is tilted relative to the vertical axis C. The tilt of the central axis S with respect to the vertical axis C, denoted by a in FIG. 2, is larger in FIG. 2 than in FIG. 1. This is explained by FIG. 2 representing the crusher 1 in crushing operation, which means that the number of revolutions of the unbalance bushing 26 in FIG. 2 is larger than in FIG. 1, showing the crusher 1 at a stand-by rpm.

As the tilted central axis S is rotated by the drive shaft 38, it will follow a gyrating motion about the vertical axis C, the central axis S thereby acting as a generatrix generating two cones meeting at a common apex 33. An angle $\alpha$, formed at the apex 33 by the central axis S of the crushing head 16 and the vertical axis C, will vary depending on the mass of the unbalance weight 30 (FIG. 1), the angular velocity at which the unbalance weight 30 is rotated, and the type and amount of material that is to be crushed. Hence, the faster the drive shaft 38 rotates, the more the unbalance bushing 26 will tilt the central axis S of the crushing head 16 and the crushing head shaft 24. Since the material in the crushing chamber 48 constrains the motion of the crushing head 16, the extent to which the central axis S may tilt from the vertical axis C is dependent on the type and amount of material present in the crushing chamber 48 (FIG. 1).

Figure 3:
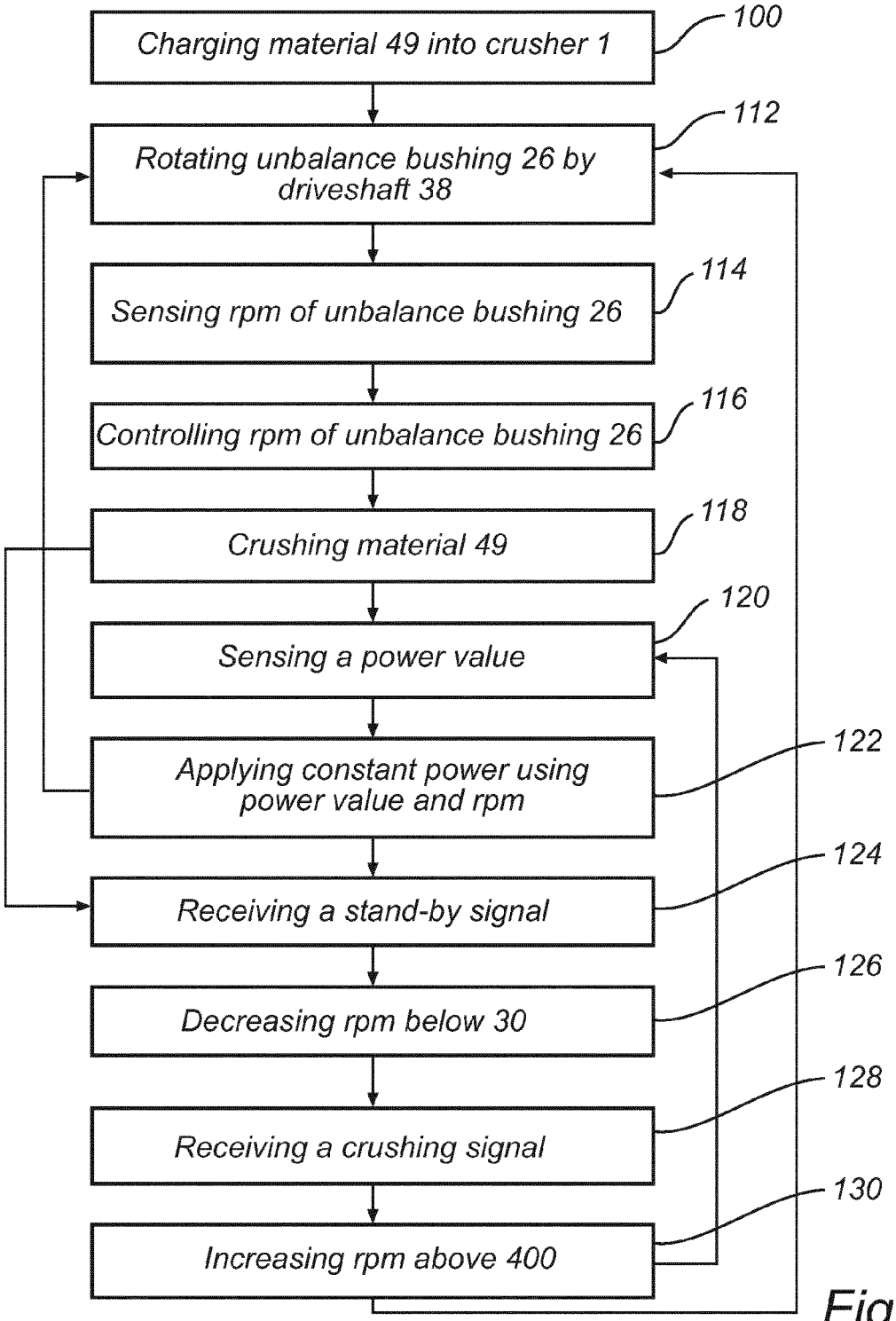
FIG. 3 is a flow chart illustrating a method of controlling the inertia cone crusher illustrated in FIGS. 1-2.

Referring to FIG. 3, a method for controlling the crusher 1 of FIGS. 1-2 will be described in more detail.

In step 100, material 49 to be crushed is charged from the feeding hopper 50 into the crushing chamber 48 of the crusher 1.

In step 112, the unbalance bushing 26 is rotated such that the crushing head 16 central axis S gyrates about the gyration axis C.

In step 114 the number of revolutions of the unbalance bushing 26 is extracted using the rpm sensor 47.

In step 116, the number of revolutions of the unbalance bushing 26 is controlled using the control system 46.

In step 118, material is crushed in the crushing chamber 48. After step 118 it is possible to continue with step 120, or to continue directly with the stand-by step 124.

In step 120, a power value is extracted.

In step 122, constant power in applied to operate the crusher. Value of the number of revolutions is used for applying the constant power. After step 122 it is possible to continue crushing material by controlling the crusher 1 and starting again at step 112, or to continue with step 124.

In step 124 a stand-by signal is received. The crusher 1 is then prepared to slow down to a number of revolutions where no significant crushing occurs. The condition of no significant crushing occurring could, for example, be evaluated by analysing information from the sensing elements 54*a*, 54*b* of the gyration sensor 54. When no movement of the gyration sensor reflection disc 27 is registered by the sensing elements 54*a*, 54*b* then no significant crushing occurs. Furthermore, the resonance rpm of the crusher 1 should be taken into consideration in the stand-by mode. The resonance rpm is individual to the crusher and could, for example, be 23 rpm. Hence, in stand-by mode the crusher is preferably operated at an rpm which is not a resonance rpm and which does not result in any significant crushing.

In step 126, the number of revolutions of the unbalance bushing 26 is decreased to a stand-by rpm which is preferably above 0 and below 30 rpm. The crusher is run at the stand-by rpm until a crushing signal is received.

In step 128, a crushing signal is received.

In step 130, the number of revolutions of the unbalance bushing 26 is increased to a crushing rpm which is preferably above 400 rpm. After step 130 it is possible to continue crushing material by controlling the crusher 1 starting again at step 112, or at step 120.

It will be appreciated that numerous variants of the embodiments described above are possible within the scope of the appended claims. For example, the use of a gyration sensor reflection disc 27 has been described above. However, the motion or position of the crushing head 16 may be measured based on the detection of other parts of the crushing head 16, the crushing head shaft 24, or any device connected thereto. Other types of sensors may be used, such as accelerometers.

Above, flexible joints 34, 36 of the Rzeppa type have been described. However, the crushing head of an inertia cone crusher may be driven via other types of flexible joints, such as universal joints.

Hereinbefore, an inertia cone crusher 1 having an unbalance weight 30 attached to the unbalance bushing 26 has been described. In other inertia cone crusher designs, the unbalance weight may have another location than in the crusher 1 described in detail hereinbefore; for example, the unbalance weight may, with appropriate and corresponding modifications to other parts of the crusher, be located on e.g. the crushing head shaft 24 and/or the vertical transmission shaft 32, in which cases those shafts would be unbalance bushings or shafts in the meaning of that feature of the appended claims.

Above, it has been described how the distances and angles $D_a$, $D_b$, and $\alpha$ may be used as measures of an amplitude of the gyrating motion of the central axis S of the crushing head 16. As will be appreciated by a person skilled in the art, also other measures indicating the magnitude of the gyrating motion of the crushing head 16 may be used as an indication of an amplitude.

A gyrating motion in the meaning of this disclosure need not be circular, but may, depending on crusher design and load, be e.g. elliptic, oval, or follow any other type of deformed generatrix due to constraints imposed by e.g. the design of the shape of the crushing chamber 48.

The invention claimed is:

1. A method of controlling crushing of material in an inertia cone crusher, comprising the steps of:

charging material to be crushed from a feeding hopper to a crushing chamber, the crushing chamber being formed between an inner crushing shell supported on a crushing head, and an outer crushing shell of the inertia cone crusher;

rotating an unbalance bushing, which is provided with an unbalance weight and rotatably connected to the crushing head, by a drive shaft, such that a central axis of the crushing head gyrates about a gyration axis;

sensing the number of revolutions of the unbalance bushing using an rpm sensor;

controlling the number of revolutions of the unbalance bushing using a control system;

sensing a power value of the inertia cone crusher;

applying a constant power input to the inertia cone crusher by adjusting the number of revolutions of the unbalance bushing; and crushing material in the crushing chamber.

2. A method of controlling crushing of material in an inertia cone crusher, comprising the steps of:

charging material to be crushed from a feeding hopper to a crushing chamber, the crushing chamber being formed between an inner crushing shell supported on a crushing head, and an outer crushing shell of the inertia cone crusher;

rotating an unbalance bushing, which is provided with an unbalance weight and rotatably connected to the crushing head, by a drive shaft, such that a central axis of the crushing head gyrates about a gyration axis;

sensing the number of revolutions of the unbalance bushing using an rpm sensor;

controlling the number of revolutions of the unbalance bushing using a control system;

receiving a stand-by signal;

decreasing the number of revolutions of the unbalance bushing to a stand-by rpm, wherein the stand-by rpm is above 0 and below 30 rpm; and crushing material in the crushing chamber.

3. The method according to claim 2, further comprising the steps of:

receiving a crushing signal; and increasing the number of revolutions of the unbalance bushing to a crushing rpm, wherein the crushing rpm is above 400 rpm.

4. The method according to claim 2, wherein the inertia cone crusher is run at the stand-by rpm for a period which is less than 1 hour.

5. The method according to claim 4, wherein the inertia cone crusher is run at the stand-by rpm for a period which is less than 30 minutes.

6. The method according to claim 4, wherein the inertia cone crusher is run at the stand-by rpm for a period which is less than 15 minutes.

7. The method according to claim 2, wherein the step of decreasing the number of revolutions of the unbalance bushing to a stand-by rpm is performed while material to be crushed is present in the feeding hopper.

8. The method according to claim 2, wherein the step of decreasing the number of revolutions of the unbalance bushing to a stand-by rpm is performed during an emptying process of the inertia cone crusher.

9. The method according to claim 2, wherein the step of decreasing the number of revolutions of the crushing head to a stand-by rpm is performed when the inertia cone crusher is empty.

10. The method according to claim 2, wherein the stand-by rpm is above 0 and below 15 rpm.

11. The method according to claim 2, wherein the stand-by rpm is above 0 and below 10 rpm.

12. An inertia cone crusher comprising:

an outer crushing shell and an inner crushing shell, said inner and outer crushing shells forming between them a crushing chamber, the inner crushing shell being supported on a crushing head, said crushing head being rotatably connected to an unbalance bushing, which is arranged to be rotated by a drive shaft, said unbalance bushing being provided with an unbalance weight for tilting the unbalance bushing when it is rotated, such that a central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber;

an rpm sensor for sensing the number of revolutions of the unbalance bushing, wherein the unbalance bushing has a stand-by rpm above 0 and below 30 rpm; and a controller for controlling the number of revolutions of the unbalance bushing.

13. An inertia cone crusher according to claim 12, further comprising a sensor for sensing at least one of a position and a motion of the crushing head.

* * * * *